United States Patent [19]

Helt et al.

[11] 4,261,418

[45] Apr. 14, 1981

[54] OUTDOOR COIL UNIT FOR HEAT PUMP

[75] Inventors: Robert W. Helt, Oklahoma City; Normand R. Beaulieu, Norman, both of Okla.

[73] Assignee: Westinghouse Electric Corp., Pittsburgh, Pa.

[21] Appl. No.: 102,599

[22] Filed: Dec. 12, 1979

[51] Int. Cl.[3] ..... F28F 19/00; F25D 19/00; F25B 13/00

[52] U.S. Cl. ..... 165/134 R; 62/298; 62/507; 62/324.1; 312/236; D23/139

[58] Field of Search ..... 62/298, 272, 324 R, 62/324 F, 531, 507, 515, 449; 312/236; 165/134; D23/141, 139, 153

[56] References Cited

U.S. PATENT DOCUMENTS

| | | | |
|---|---|---|---|
| 2,446,876 | 8/1948 | Iwashita | 62/298 |
| 2,959,933 | 11/1960 | Burke | 62/324 R |
| 3,474,856 | 10/1969 | Shriver | 62/507 X |
| 3,882,690 | 5/1975 | Duell | 62/298 X |

*Primary Examiner*—Lloyd L. King
*Attorney, Agent, or Firm*—E. C. Arenz

[57] ABSTRACT

An outside coil unit for a heat pump is provided which includes a refrigerant coil 16 with a protective grille 26, 28, the vertical edges of the grille being held by posts 30 and 45 which are tilted outwardly at the bottom to accordingly tilt the grille outwardly at the bottom so that ice and frost buildup onthe coil is not impeded in falling off the coil during defrost cycles.

4 Claims, 4 Drawing Figures

OUTDOOR COIL UNIT FOR HEAT PUMP

BACKGROUND OF THE INVENTION

The invention pertains generally to the art of heat pumps and particularly to the art of grille and coil arrangements for the outdoor unit for a heat pump.

A typical heat pump of the air-to-air type for residential use, for example, includes an indoor coil unit in the air flow system of the residence, and an outdoor coil unit which ordinarily includes a coil per se, along with a refrigerant compressor and various control elements. When the heat pump is operating in a cooling mode the indoor coil functions as an evaporator and the outdoor coil as a refrigerant condenser. When the heat pump is reversed in its operation to a cooling mode, the indoor coil functions as a refrigerant condenser while the outdoor coil functions as a refrigerant evaporator. Consequently, there will be periods when the outdoor coil must be defrosted.

Most outdoor coil units have a coil which is disposed vertically and which has a protective openwork grille of one kind or another closely adjacent the exterior face of the coil. This grille may consist of horizontal and vertical welded wires, for example, or in some cases may be of an expanded metal type of construction. When the coil accumulates frost on it and requires defrost, it will frequently be found that the frost has built out onto the grille, so that a satisfactory defrost should result in all of the frost being removed from the grille as well as from the coil itself. The close adjacency of the grille to the face of the coil tends to retain the frost and ice on the face of the coil rather than letting it fall freely off. In other words, that ice and frost which is loosened at an upper level and would tend to fall freely but for the grille may be retained by lower level horizontal wires of the grille. Also, during freezing rain storms, ice and rain which falls from one horizontal wire tends to be caught by one or more of the lower horizontal wires.

One known way to avoid this problem is to space the grille means outwardly from the outer face of the coil a sufficient distance that the ice and frost does not bridge between the coil and grille. Accordingly during defrost the ice and frost is permitted to fall off the coil without any retention by the grille. However, this requires that the unit be larger than if that spacing did not need to be accommodated.

It is an aim of this invention to provide an arrangement in which the grille does not impede ice dropoff during defrost, and in which no penalty with respect to size of the overall unit is imposed.

SUMMARY OF THE INVENTION

In accordance with the invention, an outdoor coil unit for an air-to-air heat pump is provided which includes a refrigerant coil of vertical fin and horizontal tube structure and which is vertically disposed within a cabinet which includes a top and bottom with means at the edges of the top and bottom generally framing an open-side-area generally corresponding to the exterior face area of the coil, the coil being located in the cabinet and being generally coextensive with the open-side-area, open work grille means generally coextensive with the face area of the coil is located at the outside face of the coil and means is provided at the opposite vertical edges of the grille means to permit the grille means to be tilted outwardly at the bottom and there secured so that except at the top edge of the grille means a progressively greater open space between the grille means and the exterior face of the coil is provided in a downward direction.

DESCRIPTION OF THE PREFERRED EMBODIMENTS

Figure 1:
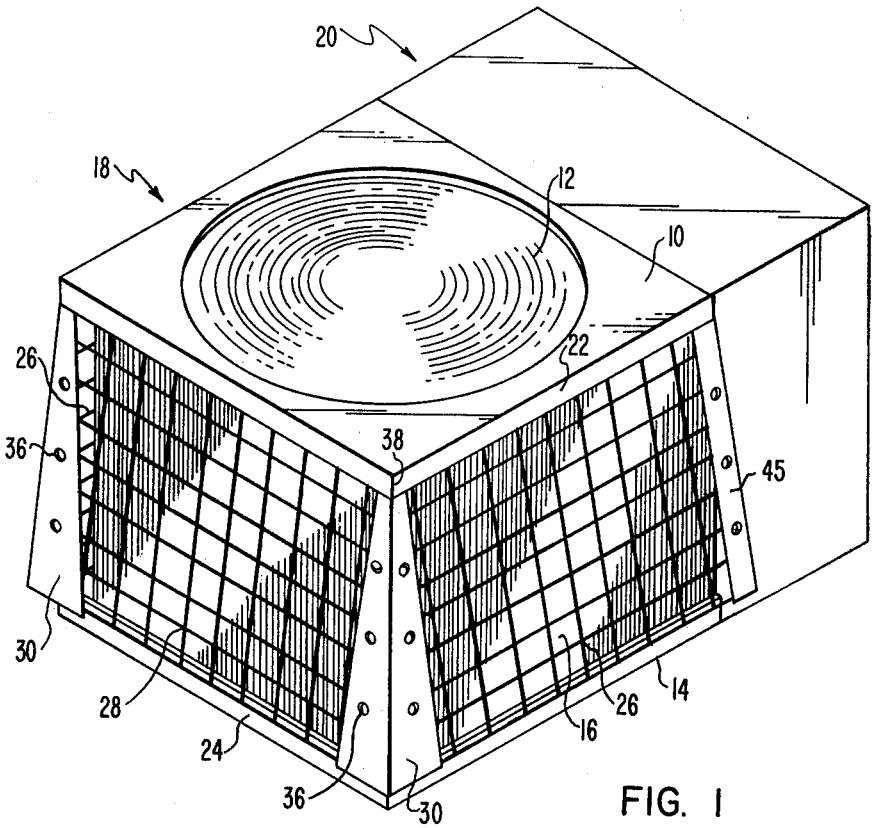
FIG. 1 is an isometric view of one type of outdoor coil unit to which the invention is applicable and with the grille means being in the outwardly tilted disposition.

Referring to FIG. 1, the outdoor coil unit of the type there shown and used herein as the main example in which the invention may be embodied includes a top portion 10 in the general form of an inverted pan which includes a grille occupied opening 12 below which the outdoor unit fan is located, a bottom portion 14 also in the general form of a shallow pan which is upwardly open, a refrigerant coil generally designated 16 of conventional vertical fin and horizontal tube structure, the coil being bent into a U-shape with rounded corners as is conventional. The cabinet as a whole comprises two separate sections, the airflow section generally designated 18 and the enclosed section generally designated 20 which, as is conventional, houses the compressor, various controls and some piping.

The airflow section of the illustration unit is generally open on the three sides which do not face the enclosed section, with open-side-areas on opposite sides and the end of the unit defined by the edge flanges 22 and 24 of the top and bottom, respectively. These open-side-areas are generally coextensive with the particular face of the coil presented to the area. A separate openwork planar grille as of welded horizontal and vertical wires, for example, is provided for each of the open-side-areas. The grilles best seen in FIG. 1 at the side and end of the unit are given the numerals 26 and 28, respectively.

At the corners at the end of the unit of FIG. 1, two corner posts 30 are provided, the corner posts being identical in construction. They are shown in their positions in which the bottom ends of the posts have been moved outwardly away from the unit so as to correspondingly tilt the grilles outwardly at the bottom at those locations. The basic construction of each corner post 30 is that of two members which are right angle in cross-sectional shape, one being nested within the other, and being attached to each other by use of screws and with the members being free along their vertical edges so as to receive, within a slot formed between them, the vertical edges of the grille means. The bottom ends of the posts are provided with means for spacing the bottom ends outwardly and securing them in that location.

Figure 2:
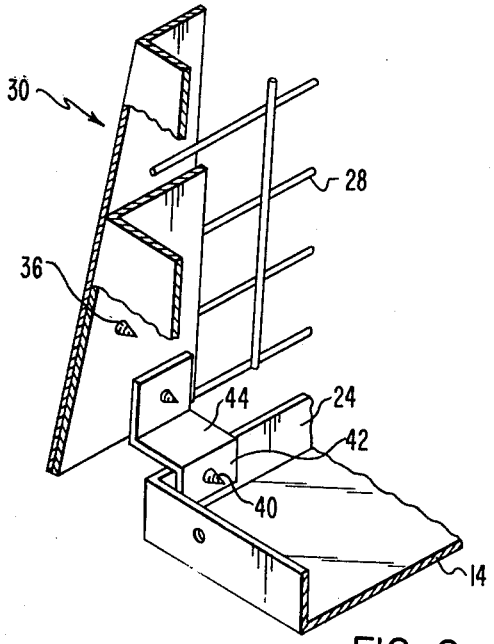
FIG. 2 is a fragmentary and partly broken view of part of the structure for holding the grille outwardly tilted at one of the corners of the unit.

Referring to FIG. 2, details of one form of suitable corner post 30 are shown with all but a fragment of one leg of the corner post being omitted to permit the details to be shown, both legs being the same. Both the outer member 32 and the inner member 34 are of right angle form in cross section and are attached together by four sheetmetal screws 36 (FIG. 1), two on each side leg. Another sheetmetal screw 38 secures the top end of the corner to the top edge flange. The corners are secured in their outward position by two screws 40 which extend through the bottom edge flanges 24 and through a depending leg 42 of the bottom stand-off members 44.

The vertical edges of the grille such as 26 and 28 are held in captured but slidable relation between the slots formed between the inner and outer member. Since the lower portions of the corner post must accommodate more sliding relations of the grille edges than the top, the corner posts are of the tapered form best seen in FIG. 1.

Figure 3:
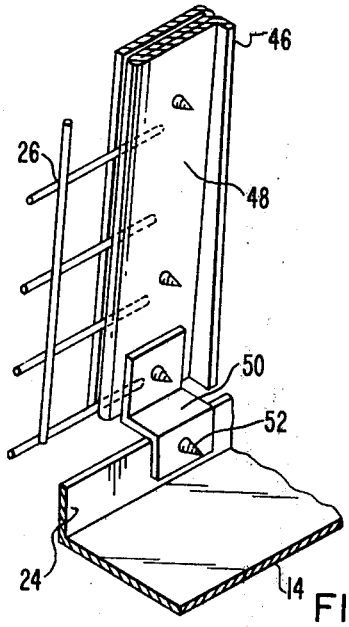
FIG. 3 is also a fragmentary and partly broken view of a part of the structure for holding the grille outwardly tilted at an edge of the grille opposite one of the corners.

The grille edge retaining means at the edges of the grille adjacent the enclosed compartment 20 includes a double folded member 45 (FIG. 3) which forms a slot 46 into which the grille 26 is received, and a right angle flange 48. The grille is held in captured relation in the slot by any suitable means such as screws 49. The stand-off 50 at the bottom is similar to that of the corner post and a screw 52 is used to secure the stand-off to the bottom pan flange 24 when the grille retaining means is in its outward position.

For purposes of space saving in shipping, the corner posts and the retainer means 45 are located in their inward positions in which they are generally vertically aligned with the bottom portion of the cabinet. In that connection it is noted that the refrigerant coil 16 has a U-shape in which the corners of the U are rounded so there is adequate space to accommodate the stand-offs 44 with the bottom of the posts in their inward position. The stand-off 50 of the retainer means 45 is accommodated in its inward position by space within the cabinet beyond the end of the U-shaped coil 16.

Figure 4:
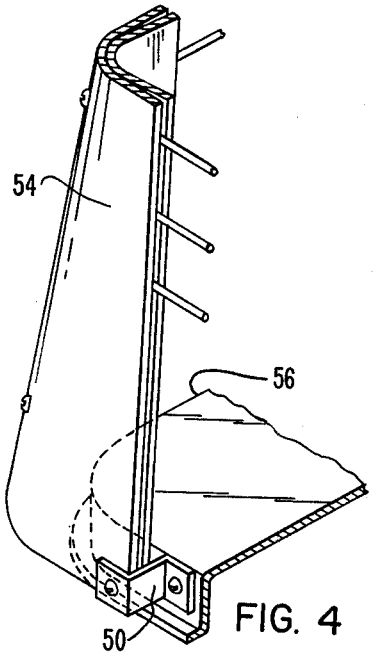
FIG. 4 is a fragmentary view of a corner portion of an outdoor coil unit of the type which includes rounded corners at the top and bottom as distinct from the square corners of the unit of FIG. 1.

It will be appreciated that the principles of the invention are applicable to coil units for heat pumps having forms other than that shown in FIG. 1. An appreciation of how the invention can be applied in a coil unit having a cabinet with rounded corners rather than square corners is shown in FIG. 4 in which the corner post 54 has a shape in horizontal cross-section corresponding to the contour of the rounded corner. The vertical part of the post 54 has the same general type of construction as the vertical part of the corners 30 in that an inner member is nested within an outer member and attached to each other in a way which provides the grille edge receiving recess along each vertical edge of the post 54. The bottom part of such a post 54 necessarily has to be different from that of post 30 since there is no room to accommodate inwardly projecting parts. Regardless, the unit may be shipped with the corner post 54 in a position in which the bottom of the post abuts the downturned flange 56 of the bottom pan and is so secured for shipping purposes. A pair of Z-shaped brackets 58 for each corner post is shipped with the unit. At the job site, the lower end of the post 54 is pulled out and the Z-shaped brackets are secured to the flange 56 and the bottom end of the post to hold the post and accordingly the grilles in the outwardly tilted position. An alternative fastening arrangement (not shown) would be the use of long screws with tube sleeves of the right length to space the bottom end out the right distance.

The principles of the invention are also applicable to units in which the coil may occupy only a single plane. Finally, there may be instances where the grille may be affixed permanently in an outwardly tilted disposition.

Another application of the invention is envisioned in providing the post parts described herein in the form of a kit to permit a field fix for units incurring substantial problems because of the grilles holding up ice drop-off from the coils.

We claim:

1. An outside coil unit for a heat pump comprising:

a refrigerant coil comprising a vertical fin and horizontal tube structure and being vertically disposed;

a cabinet structure including a top portion and a bottom portion and means at the edges of the top and bottom portions generally framing an open-side-area generally corresponding to the exterior face area of said coil;

said refrigerant coil having a size and being located in said cabinet to be generally coextensive with said open-side-area;

openwork grille means generally coextensive with said face area of said coil and located exteriorly of the coil;

generally vertically disposed edge means at the opposite vertical edges of said grille means having their top ends connected to said top portion of said cabinet and their bottom ends being movable from an inward position generally vertically aligned with the edges of the bottom portion of said cabinet to an outward portion away from the bottom edge portions of the cabinet, said edge means including means holding the vertical edges of said grille means thereto, whereby movement of said bottom ends to said outward position results in an inclined disposition of said grille means; and means to secure the bottom ends of said edge means in said outward position.

2. A unit according to claim 1 wherein:

said cabinet structure includes two oposite side open-side-areas and an end open-side-area contiguous to both side areas;

said edge means includes one pair thereof at the junctures of the side open-side-areas with the end open-side-area, and another pair at the opposite ends of said open-side-areas; and said holding means of said one pair of edge means forms a slidable connection with the vertical edges of said grilles.

3. A unit according to claim 2:

said one pair of edge means comprise an outer member and an inner member nested therein, both being of generally angle form in horizontal cross-section and attached together along their vertical center-portions, the outer and inner members having a sufficient space between their edges to define slots within which the vertical edges of said grille means is received in slidable relation.

4. An outside coil unit for a heat pump, comprising:

a refrigerant coil comprising a vertical fin and horizontal tube structure and being vertically disposed;

a cabinet structure containing said coil and having an open-side-area at the exterior face of the coil, said refrigerant coil being generally coextensive with said open-side-area;

openwork grille means generally coextensive with said face area of said coil and being located adjacent the exterior face of said coil; and means supporting said openwork grille means in an inclined disposition with the top edge thereof closely adjacent said coil and the botttom edge spaced outwardly thereof.

* * * * *